US006712058B2

(12) United States Patent
Porter

(10) Patent No.: US 6,712,058 B2
(45) Date of Patent: Mar. 30, 2004

(54) CAMOUFLAGE AND COVER APPARATUS

(76) Inventor: Norman C. Porter, 17809 New Gambier Rd., Mt. Vernon, OH (US) 43050

( * ) Notice: Subject to any disclaimer, the term of this patent is extended or adjusted under 35 U.S.C. 154(b) by 0 days.

(21) Appl. No.: 10/033,495

(22) Filed: Dec. 28, 2001

(65) Prior Publication Data

US 2003/0124270 A1 Jul. 3, 2003

(51) Int. Cl.[7] ..... F41B 5/00; A41G 1/00
(52) U.S. Cl. ..... 124/86; 428/17; 428/27
(58) Field of Search ..... 124/25.5, 25.7, 124/86; 224/916; 428/17, 18, 21, 24, 27, 919

(56) References Cited

U.S. PATENT DOCUMENTS 2,893,149 A * 7/1959 Reece et al.
3,050,891 A * 8/1962 Thomsen et al.
3,616,105 A * 10/1971 Marks
4,517,230 A 5/1985 Crawford
4,774,113 A * 9/1988 Shaffer ..... 428/18
4,817,579 A 4/1989 Mathias
4,876,817 A 10/1989 Hill
5,944,041 A 8/1999 Kitchens
5,958,526 A 9/1999 Spickelmire
6,060,142 A 5/2000 Rossini

* cited by examiner

*Primary Examiner*—John A. Ricci
(74) *Attorney, Agent, or Firm*—Jason H. Foster; Kremblas, Foster, Phillips & Pollick

(57) ABSTRACT

An apparatus that can be mounted to a quiver on a bow provides camouflage and cover for the bow and a shooter. The apparatus is a hollow shaft with a first end having a tapered tip, and a second opposite end. A plurality of holes is formed perpendicularly through the sidewall. The holes are confined to an area of the shaft body that is substantially three-fourths of the circumference of the sidewall. A plurality of artificial foliage bundles is attached to the shaft body by a basal wire stem that is mounted in a respective one of the holes.

9 Claims, 7 Drawing Sheets

CAMOUFLAGE AND COVER APPARATUS

BACKGROUND OF THE INVENTION

1. Field of the Invention

This invention relates generally to camouflage and other visual cover for hunters and the like.

2. Description of the Related Art

Several types of camouflage and visual cover inventions have been used for hunters and hunting equipment. Generally, such inventions include portable artificial foliage or netting that is adapted to be fixed to the hunter and hunting equipment.

In particular, U.S. Pat. No. 4,517,230 to Crawford shows an artificial leaf construction. The artificial leaves are attached to a flexible fabric strip, which in turn can be fixed to clothing and hunting equipment.

U.S. Pat. No. 4,817,579 to Mathias discloses a camouflage panel for attachment to a bow. The panel comprises a frame with camouflage netting. The netting has an opening to allow an archer to see through the panel for aiming.

U.S. Pat. No. 4,876,817 to Hill discloses a bow-mounted blind. This invention is designed with flaps and openings to permit clear vision of a target.

U.S. Pat. No. 5,944,041 to Kitchens discloses a hunting blind for attachment to a bow. The blind is a camouflage screen supported by a frame and rods. The screen may be collapsed when aiming at a target.

U.S. Pat. No. 5,958,526 to Spickelmire discloses adhesive camouflage patches for attaching to hunting clothing and rifles. The patches are colored to fit the season and background.

U.S. Pat. No. 6,060,142 to Rossini discloses a camouflage system of material strips colored similarly to the respective hunting environment. The strips of camouflage material are attached to clothing and equipment by clips.

A magazine article in the August 1986 issue of Bow & Arrow Magazine describes the negative effects of shiny factory paint on hunting equipment and suggests a method of camouflage for a bow. Specifically, the author suggests a paint and wrapping for a bow to remove the shine that scares game.

A catalog for the year 2002 from Precision Shooting Equipment, Incorporated (PSE) describes a cover system for a hunter and equipment. The cover consists of nylon artificial foliage having a stem fixed to an adhesive backing. The adhesive backing enables the foliage to be adhered to the hunter and his or her equipment, in particular, bow limbs.

The need exists for a camouflage device that employs realistic artificial foliage configured to provide optimal cover for the hunter and equipment. The need exists for an apparatus that provides a pattern of cover for a weapon that does not interfere with the hunter's ability to operate the weapon effectively.

BRIEF SUMMARY OF THE INVENTION

The invention is an apparatus that preferably mounts to a quiver on a bow to hinder visual detection of a shooter and the bow. The preferred apparatus is a shaft with bundles of artificial foliage attached to the shaft in a predetermined pattern. The bundles are mounted in holes formed through a sidewall in a confined area of the shaft.

The bundles extend from the shaft, forming an arrangement of artificial foliage that provides optimal cover for the shooter and the bow. Preferably, at least three longer bundles with adjustable wire stems are attached to the shaft. A tip of each of the longer bundles extends from the shaft a distance that is about equal to the shooter's body width for providing cover for the shooter's body. The three longer bundles can be precisely adjusted to surround an aiming window of the bow, thereby enhancing the effectiveness of the cover without interfering with the shooter's aim or arrow's flight.

Figure 1:
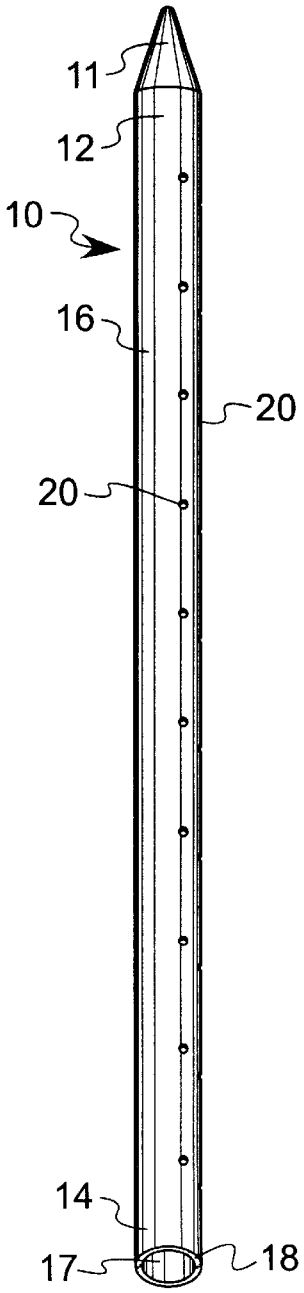
FIG. 1 is a view in perspective illustrating the preferred shaft.

In describing the preferred embodiment of the invention, which is illustrated in the drawings, specific terminology will be resorted to for the sake of clarity. However, it is not intended that the invention be limited to the specific term so selected, and it is to be understood that each specific term includes all technical equivalents that operate in a similar manner to accomplish a similar purpose. For example, the words connected and similar thereto are often used. They are not limited to direct connection, but include connection through other elements where such connection is recognized as being equivalent by those skilled in the art.

DETAILED DESCRIPTION OF THE INVENTION

The invention is an apparatus having a shaft 10 with a first end 12 and a second end 14 opposite the first end 12, as shown in FIG. 1. The first end 12 of the shaft 10 has a tapered tip 11. The second end 14 has an opening 17. The shaft 10 is made of a light, rigid material such as aluminum, but it could be wood, plastic or a composite, such as fiberglass.

Figure 2:
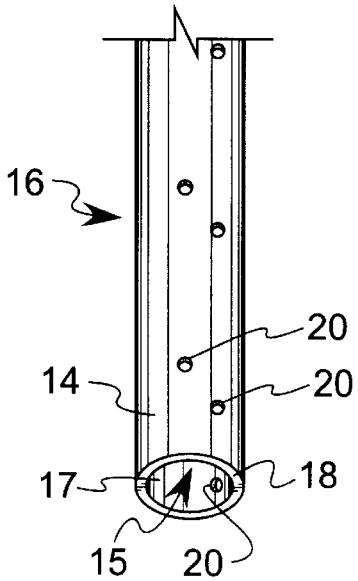
FIG. 2 is a view in perspective illustrating a section of the shaft body.

A shaft body 16 extends between the ends 12 and 14 and includes the entire shaft 10 except for the tip 11. The shaft body 16 is preferably hollow. The shaft body 16 has a sidewall 18 extending from the base of the tip 11 to the second end 14. FIG. 2 shows the second end 14 and a portion of the shaft body 16. The interior surface of the preferably cylindrical sidewall 18 defines a passage 15. The passage 15 extends through the shaft 10, from the tip 11 to the opening 17. The shaft 10 is approximately 30 inches long, resembling a conventional arrow shaft in size.

As shown in FIGS. 1 and 2, the preferred shaft 10 has a plurality of perpendicular holes 20 formed through the sidewall 18. The holes 20 are formed in a predetermined pattern, in a confined area of the shaft body 16. The confined area in which the holes 20 are formed extends almost the entire length of the shaft body 16, and slightly more than half of the circumference of the sidewall 18.

Figure 3:
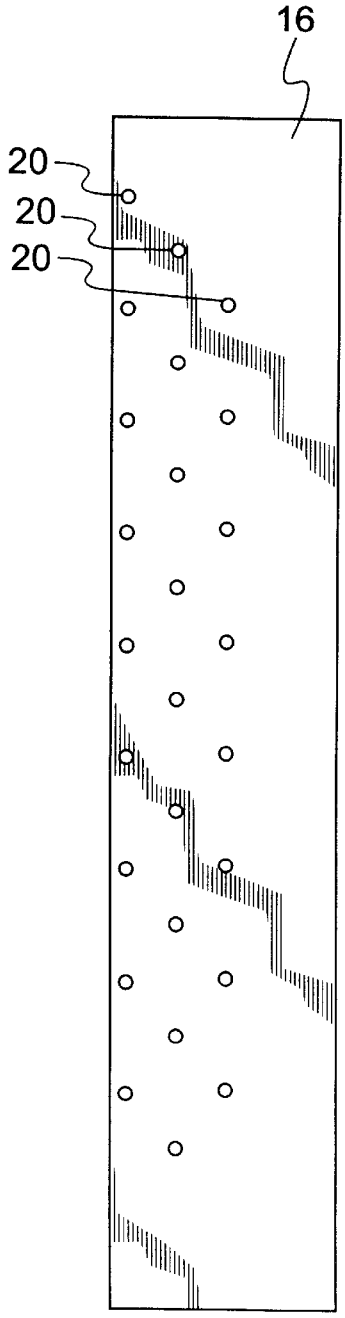
FIG. 3 is a development view of the shaft body.

FIG. 3 is a development view of the shaft body 16, as if it had been slit lengthwise and spread open. The holes 20 are aligned in three longitudinal rows in the confined area of the shaft body 16 which is about the leftward half of the FIG. 3 view. The rows are spaced equidistant apart within the confined area at approximately every 90 degrees of the circumference of the sidewall 18. Thus, the three rows with each positioned at every 90 degrees results in slightly less than 180 degrees of the circumference having no holes. The first row consists of ten of the holes 20 formed through the sidewall 18. The first of the holes 20 in the first row is formed about two and one-half inches from the tip 11, and the remaining nine of the holes 20 in that same row are spaced at three-inch intervals along the shaft body 16. The second row consists of nine holes formed through the sidewall 18. The first of the holes 20 in the second row is formed about three and one-half inches from the tip 11, and the remaining eight holes in that row are spaced at three-inch intervals along the shaft body 16. The third row consists of eight holes formed through the sidewall 18. The first of the holes 20 is formed four and one-half inches from the tip 11, and the remaining seven holes are spaced at three-inch intervals along the shaft body 16.

Figure 4:
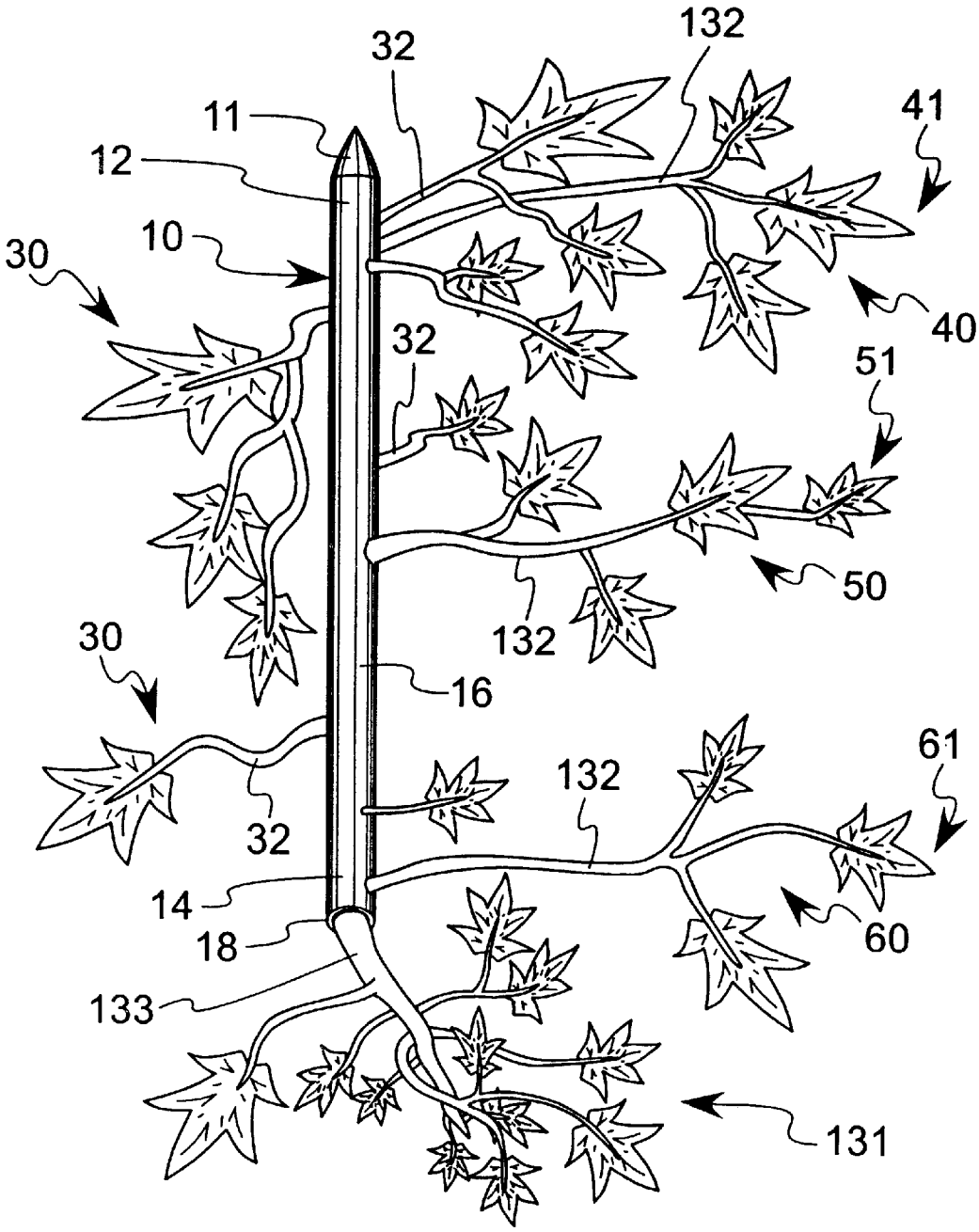
FIG. 4 is a side view illustrating a bow having the shaft mounted in an attached quiver.

In the preferred embodiment, a plurality of artificial foliage bundles 30 is attached to the shaft body 16, as shown in FIG. 4 by inserting stems of the foliage in the holes 20. In FIG. 4, several of the bundles 30 and the respective holes 20 have been omitted for clarity. The alternating, staggered spacing of the holes 20 is advantageous, first, because the spacing imparts a specific arrangement to the bundles 30 along the shaft body 16 that avoids a predictable, noticeable pattern. Second, the predetermined spacing of the holes 20 preserves the structural integrity of the sidewall 18, so the shaft 10 is not substantially weakened at any point by the holes 20.

Each of the bundles 30 has a basal wire stem 32 coated in soft plastic. The basal wire stem 32 of each of the bundles 30 may be bendable and once bent may stay bent. Each basal wire stem 32 is mounted in one of the holes 20, thereby serving to anchor a respective one of the bundles 30 to the shaft body 16. The stem 32 tightly contacts the sidewall 18 at the edge of each of the respective holes 20, resulting in a friction fit that maintains each of the bundles 30 secured to the shaft body 16.

The stem 32 may be secured to the shaft body 16 also by more than mere contact with the edge of the sidewall 18. Depending on the machining process, there may be a burr or other sharp edge on the sidewall 18 that contacts the stem 32, acting as a barb with respect to the stem 32. If the fully inserted stem 32 is tugged outwardly, the plastic coating drags against the burr or sharp sidewall 18. This has a barb effect by digging into the stem coating to prevent removal of the stem 32. Glue can be used to further secure the stem 32 to the shaft body 16. In any case, the stem 32 must be secured to the shaft body 16 to an extent necessary for use in rigorous outdoor settings.

In addition to the typical bundles 30 of approximately the same length, the preferred shaft body 16 has three longer, adjustable bundles mounted to the sidewall 18, as shown in FIG. 4. A longer top bundle 40 is mounted near the tip 11. A longer bottom bundle 60 is mounted to the shaft body 16 near the second end 14. A longer central bundle 50 is mounted substantially mid-way between the bundles 60 and 40. Each bundle 40, 50, and 60 has a tip 41, 51, and 61, respectively, that extends from the shaft body 16 to a predetermined position in front of, or at the side of, the shooter. Preferably, the distance is about eighteen inches. Each of the bundles 40, 50, and 60 has a bendable wire stem 132 so that it can be bent to a position where it stays.

The preferred embodiment includes a bundle 131 with a thickened stem 133, as shown in FIG. 4. The bundle 131 is mounted in the opening 17 of the second end 14 in the same manner as each of the bundles 30 is mounted in its corresponding opening 20. The thickened stem 133 is mounted in the opening 17 and tightly contacts the sidewall 18. Alternatively or additionally, glue or tape can be used to secure the stem 133 in the second end 14. The stem 133 with the bundle of artificial foliage 131 protrudes from the opening 17.

The preferred foliage is made of silk leaves. However, the artificial foliage may be made from a different material so long as it generates minimal sound when contacting tree limbs, brush, and other objects likely to be encountered in a hunting environment. The artificial foliage style, color, shape, thickness, leaf size, and pattern can vary as needed, in order to adapt the invention to provide cover in a particular environment. The artificial foliage contemplated for use with the invention can include pine needle branches, deciduous leaves, vines, tropical foliage, twigs, small branches or vines. For example, an oak leaf shape can be used.

Figure 5:
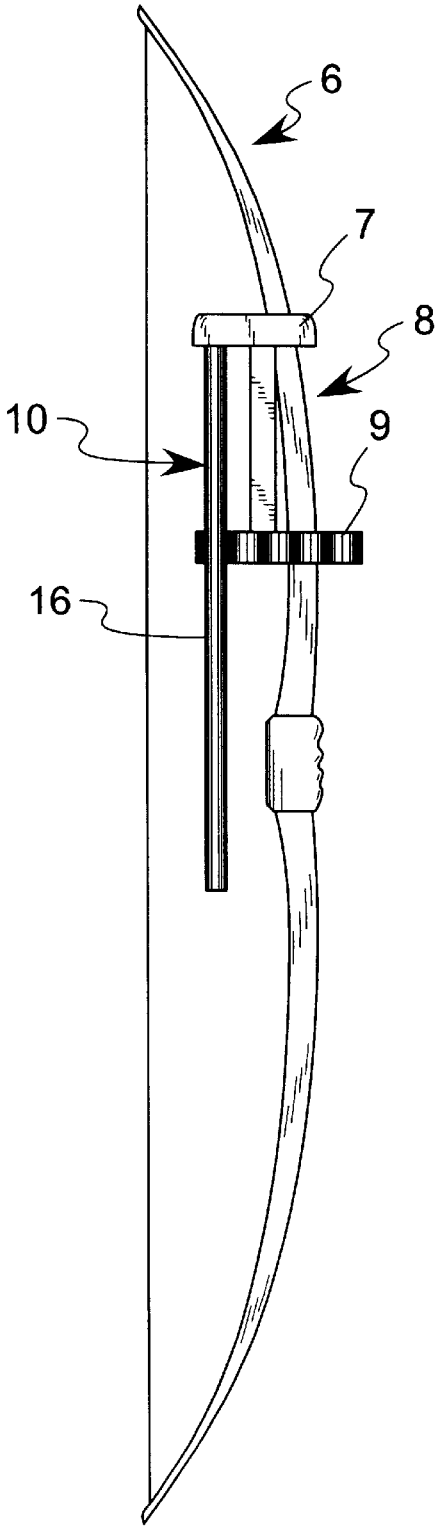
FIG. 5 is a side view illustrating the preferred embodiment of the present invention.
Figure 6:
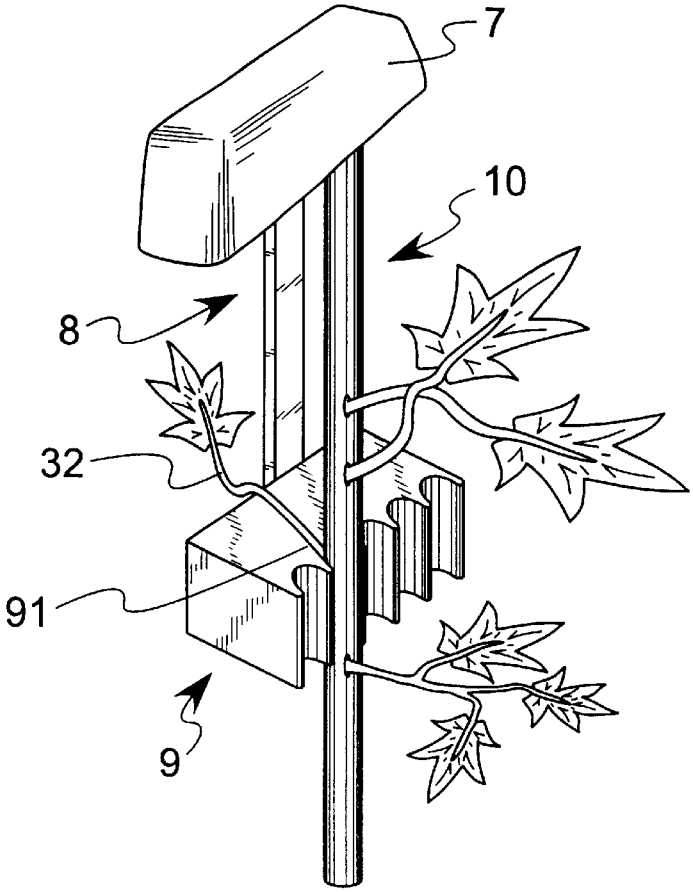
FIG. 6 is a view in perspective illustrating the shaft mounted in the quiver.

As shown in FIGS. 5 and 6, the shaft 10 can be removably mounted to a quiver 8 on a bow. (In FIG. 5, the bundles 30 are omitted for clarity.) The quiver 8 is fixed to the bow 6 in a conventional manner, and the quiver 8 may be mounted on a long bow, a compound bow, or a cross bow. The typical quiver 8 consists of a housing 7 and at least one conventional arrow shaft-grasping structure, such as a clip 9 or a clamp. The shaft body 16 is preferably cylindrical for fitting into a recess formed in the clip 9 in the same manner as a conventional arrow shaft. However, the shaft body 16 can be any configuration to make the shaft 10 adapted to fit in a quiver clip.

FIG. 6 shows the shaft 10 mounted to the quiver 8 in a manner similar to the manner in which a conventional arrow is mounted to the quiver 8. The tip 11 (not visible in FIGS. 5 and 6) is received by the housing 7. The shaft body 16 is received by a holding structure such as the clip 9. The clip 9 is fixed to the quiver 8.

Returning to FIG. 4, the adjustable wire stem 132 of each of the elongated bundles 40, 50, and 60 enables the shooter to adjust the bundles 40, 50, and 60 to cover specific areas of the shooter and the bow 6 when the device is mounted in the quiver of the bow. For example, the aiming window of the bow 6 is the field of vision through which the shooter aims at a target. The aiming window is usually defined by structures on the bow 6, such as a frame with sighting pins (not shown). The bundles 40, 50, and 60 can be adjusted to surround the aiming window, thereby hiding the shooter from what the hunter is aiming at, without hindering aiming or shooting ability.

Preferably, when the shaft 10 is mounted to the quiver 8, at least one of the stems 32 is in contact with an upper edge 91 of the clip 9, as shown in FIG. 6. The upper edge 91 provides support to the contacting stem to keep the shaft 10 from shifting downwardly when held in the quiver 8 which can occur after repeatedly firing the bow. The staggered pattern of holes 20 ensures that, regardless of where the clip 9 is positioned on the manufactured quiver 8, at least one stem 32 will contact the upper edge 91 to support the shaft 10.

Figure 7:
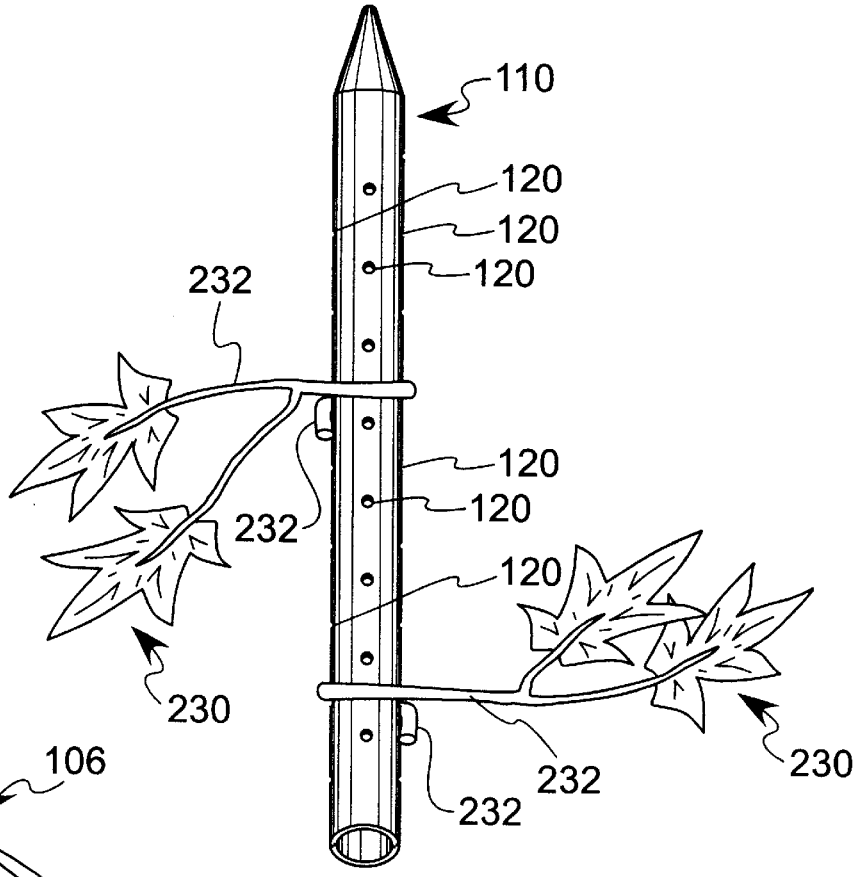
FIG. 7 is a view in perspective illustrating an alternative embodiment of the present invention.

It is not critical for the shaft 10 to be hollow. In an alternative embodiment shown in FIG. 7, a plurality of holes 120 is formed through a solid shaft 110, and a plurality of bundles 230 is attached to the shaft 110. A stem 232 of one of the bundles 230 is inserted into one of the holes 120, until the stem 232 protrudes from the opposite side of the shaft 110. The part of the stem 132 that protrudes from the shaft is bent substantially perpendicular to the longitudinal axis of the stem 32 and against the shaft 110. The remainder of the wire stem 232 is then bent around the shaft 110. Additionally or alternatively, each of the stems 232 may be secured with glue. In FIG. 7, several of the bundles 230 have been omitted for clarity.

Figure 8:
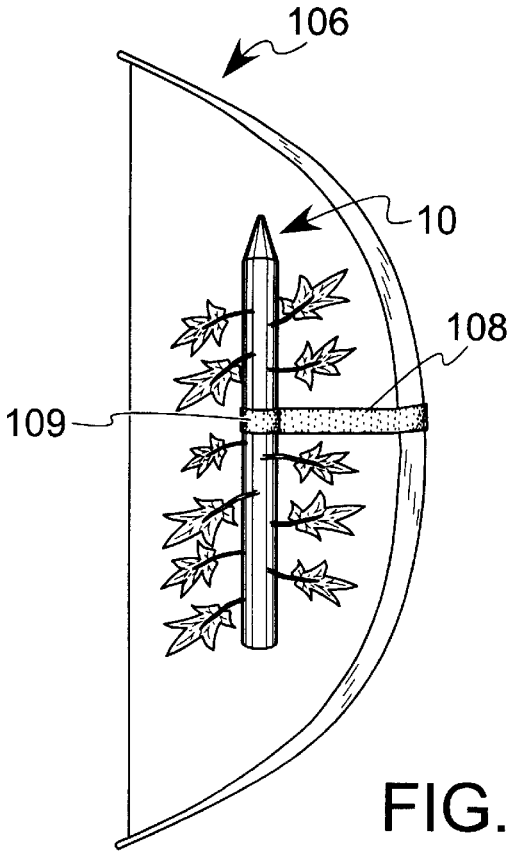
FIG. 8 is a side view illustrating an alternative embodiment of the present invention.

Alternatively, as shown in FIG. 8, the shaft 10 may also be removably mounted to a bow 106 that lacks a quiver as shown in FIGS. 5 and 6. At least one rod 108 extends laterally from the bow 106. The rod 108 has a clip 109. The shaft 10 is held by the clip 109 in a position relative to the bow 106 that substantially corresponds to the position of the shaft 10 when it is held in the quiver 8 shown in FIGS. 5 and 6.

Figure 9:
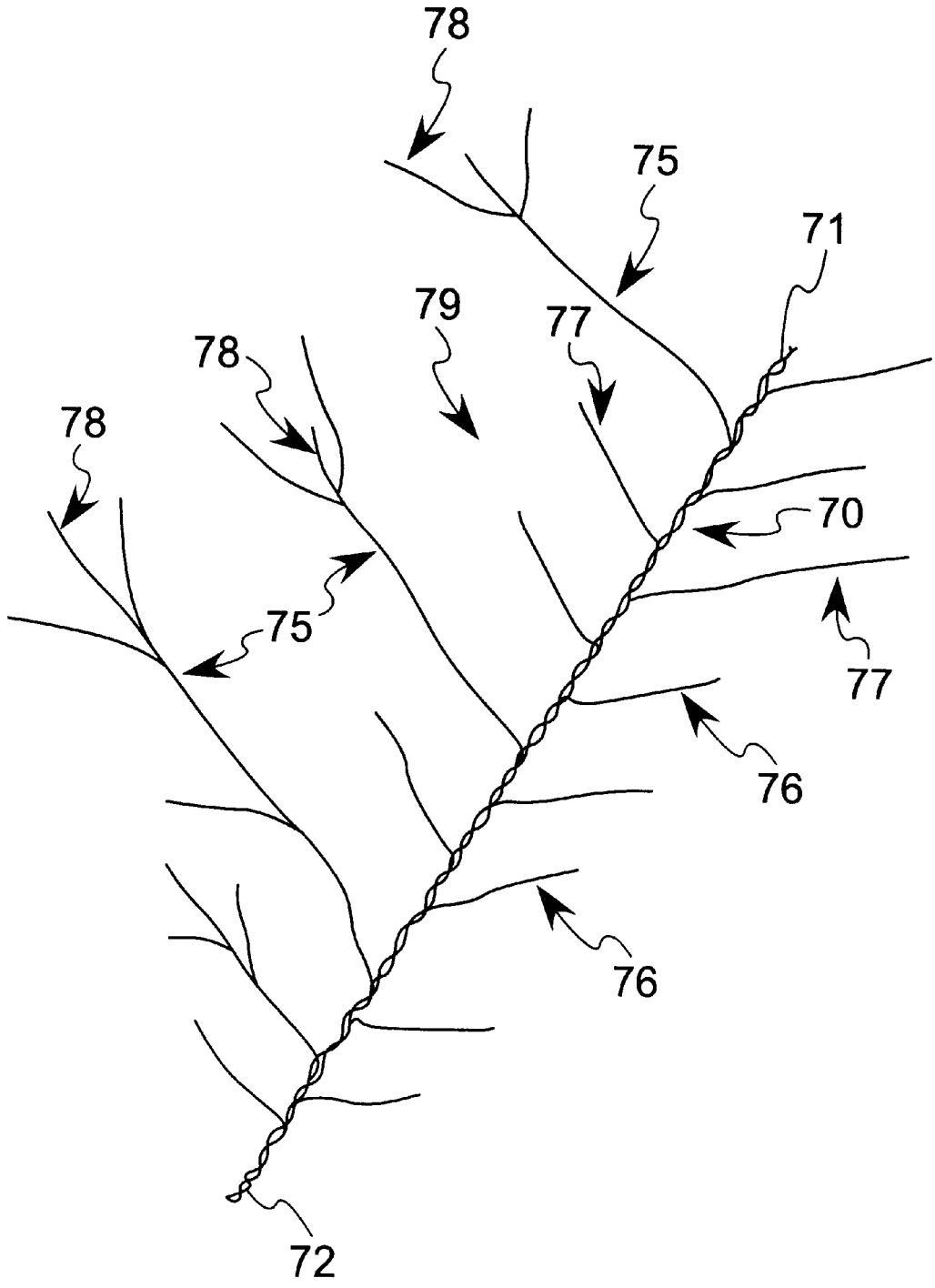
FIG. 9 is a side view of a wire lattice used to form an alternative embodiment shown in FIG. 10.

In another alternative embodiment shown in FIG. 9, the invention is made from a unitary piece of twisted wires resembling a branch that has been fractured from a tree. A wire lattice 79 has internal trunk wires 70 spanning longitudinally from a top 71 to a bottom 72. The trunk wires 70 are preferably made of three metal wires, each one having a length of about thirty-one inches. Of course, one could use two twisted wires or any other reasonable number. Using three wires ensures that the trunk wires 70 are sufficiently rigid for performing in the intended environment, which is typically rugged, but are not too heavy. It is alternatively contemplated that a single metal wire may be used instead of the trunk wires 70 if it is made of a material that is sufficiently rigid at such lengths.

Three types of branch wires 75, 76, and 77 extend laterally from the trunk wires 70 and are angled slightly upwardly toward the top end 71. The branch wires 75–77 are single bendable wires interwoven into and around the trunk wires 70. Alternatively, the branch wires 75–77 can be welded, soldered or glued to the trunk wires 70, or otherwise fixed in a manner that results in the necessary structural rigidity for the invention. A plurality of four-inch branch wires 76, and a plurality of six-inch branch wires 77, are arranged along the trunk wires 70.

The branch wires 75 are arranged on a single side of the trunk wires 70, as shown in FIG. 9. At least three approximately fourteen-inch long branch wires 75 are spaced substantially equidistant along one side of the trunk wires 70. The branch wires 75 are adjustable for bending to specific positions surrounding the hunter and the bow (not shown) and are analogous to the bundles 40, 50 and 60 of the FIG. 4 embodiment. There are about 12–14 leaves fixed to each of the branch wires 75. Also, the branch wires 75 have a plurality of offshoot branches 78. The offshoot branches 78 are single wire pieces that are shorter than the branch wires 75 and join to the branch wires 75.

Plastic material is coated on essentially the entire wire lattice 79 of FIG. 9, such as by injection molding. The wires of the trunk wires 70 and the branch wires 75–77 become covered by the plastic, but the plastic does not substantially hinder the wires' ability to bend. An amount of the plastic is applied to the trunk wires 70 to form a diameter of about three-eighths of an inch for the trunk 80. A top 81 is tapered, extending about two inches beyond the top end 71 of the trunk wires 70. This permits this top 81 to be trimmed with a knife to fit any quiver so that a stem can abut the part of the quiver that changes arrow shafts. Thus, the finished product of FIG. 10 resembles the embodiment of FIG. 4 but is made in a different manner. Leaves are then attached to the wires as shown.

Figure 10:
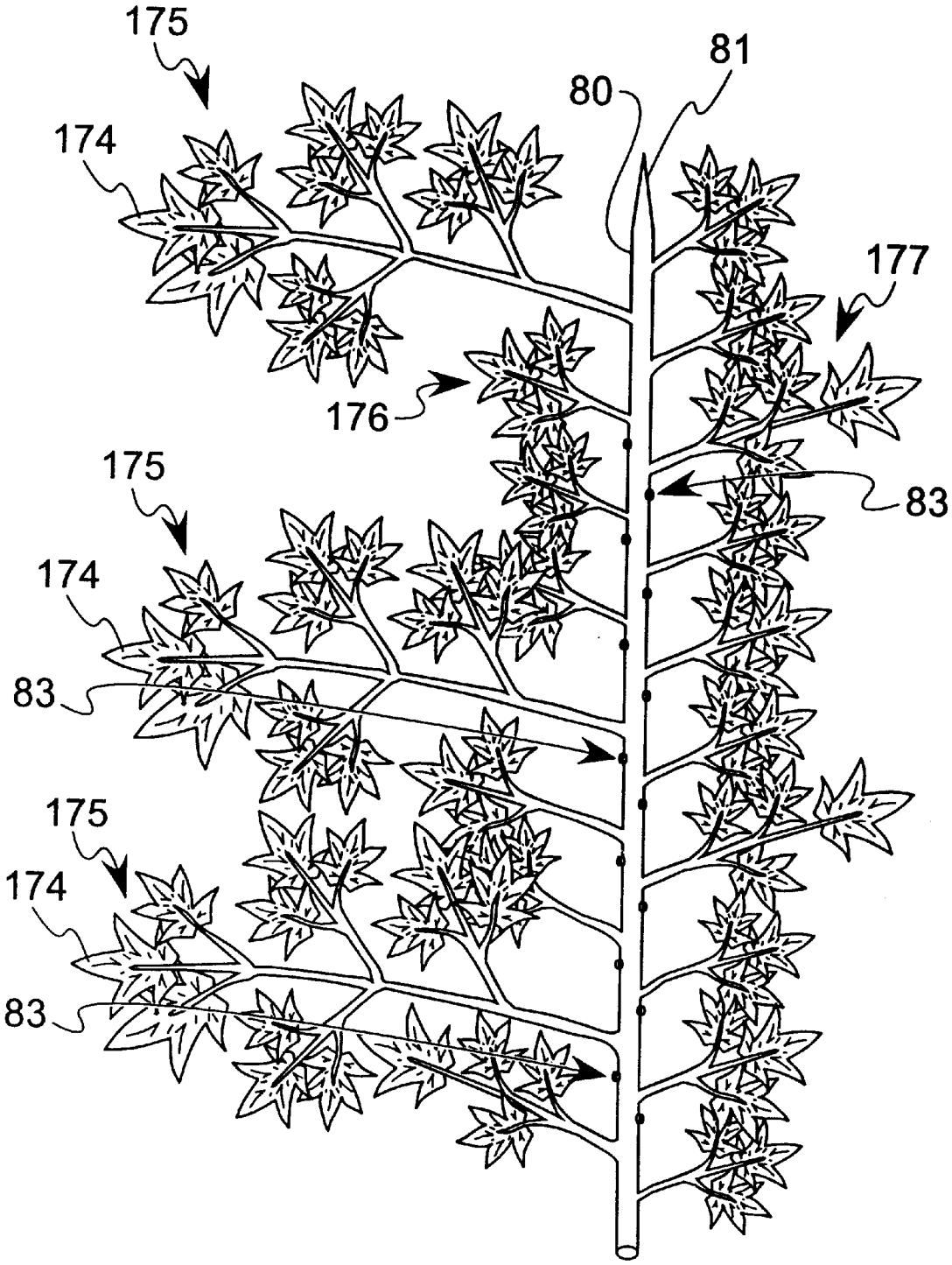
FIG. 10 is a side view of the completed embodiment shown in FIG. 9.

As shown in FIG. 10, the branch wires 75, 76, and 77 are made to resemble a plurality of material branches by coating with plastic and attaching leaves to form the branches 175, 176, and 177, respectively. Each of the branches 175 has a tip 174 extending from a trunk 80 a predetermined distance that is about equal to a shooter's body width.

The plastic can be colored with a dye, or it can be painted, to simulate a natural branch. The trunk 80 can be formed with features resembling structures of a natural branch, such as leaf scars and bark. A plurality of knots 83 that resemble leaf scars is formed in an alternating pattern along the trunk 80. Each of the knots 83 extends from the trunk 80 about one-fourth of an inch and has a diameter of about one-eighth of an inch, although the knots 83 can have a variety of shapes and sizes.

Figure 11:
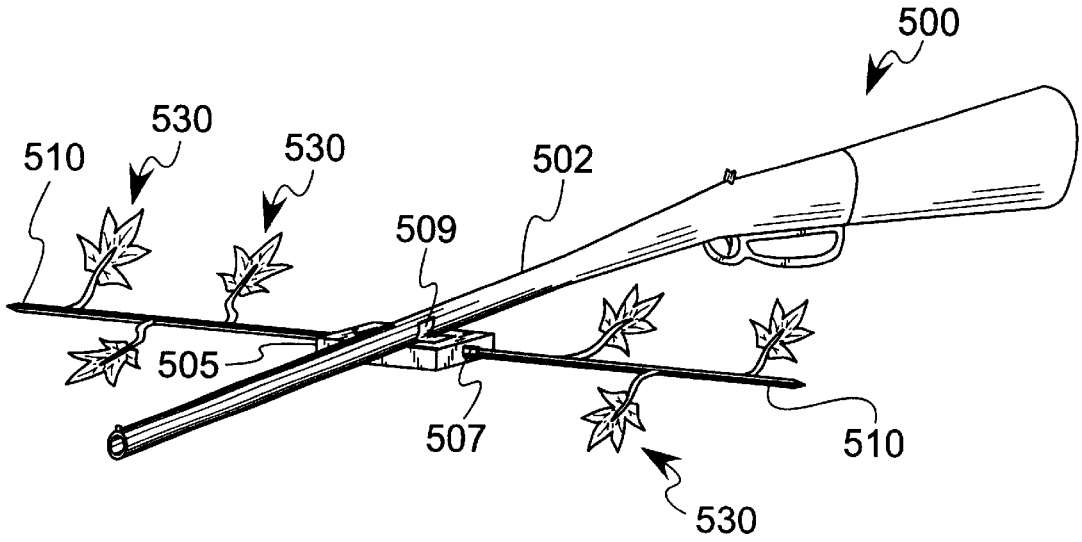
FIG. 11 is a view in perspective illustrating an alternative embodiment of the present invention.

Another embodiment of the invention is adapted for being removably mounted to a barrel 502 of a gun 500, as shown in FIG. 11. At least one clip 509 is fixed to a base 505 for removably mounting the base 505 to the barrel 502. The base 505 is substantially cube-shaped, but this shape is not essential. At least two substantially identical shafts 510 are mounted to opposite sides of the base 505. A plurality of artificial bundles 530 is substantially permanently mounted to the shafts 510 as described above for the preferred embodiment. The barrel 502 is a single barrel, but the invention also fits on a double-barreled gun and guns of various configurations.

Figure 12:
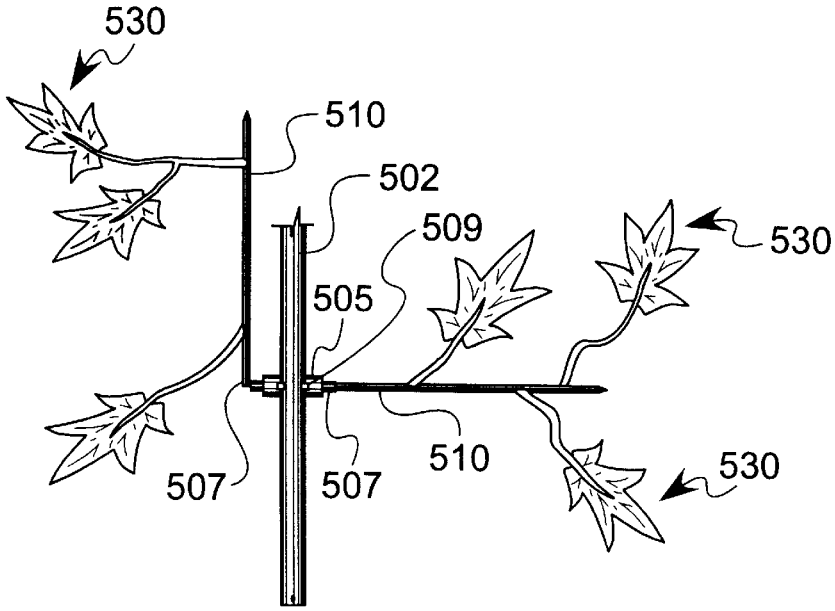
FIG. 12 is a top view illustrating the alternative embodiment of FIG. 11.

Each of the shafts 510 is mounted to the base 505 by a knee-joint 507. The knee-joint 507 enables the shafts 510 to pivot between a position substantially parallel to the barrel 502 (as shown in one side of FIG. 12) and a position substantially perpendicular to the barrel 502. The shafts 510 are stored in the parallel position to minimize the risks of snagging branches and brush. When a shooter desires to camouflage himself while aiming and shooting the gun 500, the shafts 510 are rotated outwardly, pivoting on the respective knee-joint 507, until the shafts 510 are substantially perpendicular to the barrel 502. The artificial foliage is then positioned lateral to the barrel 502 and in front of the shooter. This arrangement of artificial foliage provides optimal cover by being in front of the shooter but not in front of the shooter's field of vision for open sights or sighting scope, which is typically along the top of the barrel 502. The artificial foliage is spaced far enough from the shooter not to interfere with his movements but close enough to provide effective cover by being attached to the gun 500. Similarly, the base 505 can be removably mounted to a crossbow (not shown).

While certain preferred embodiments of the present invention have been disclosed in detail, it is to be understood that various modifications may be adopted without departing from the spirit of the invention or scope of the following claims.

What is claimed is:

1. An apparatus for hindering visual detection, the apparatus comprising:

(a) at least one shaft including wire in a sheath forming a coating, said shaft being removably mounted to a bow, the shaft having
   i. a first end,
   ii. a second end opposite the first end, and
   iii. a plurality of side branches extending from the shaft;

(b) artificial foliage mounted to each of the side branches; and (c) at least one artificial foliage bundle that is larger than the side branches and is mounted to the shaft, said at least one artificial foliage bundle having a tip extending from the shaft a predetermined distance.

2. The apparatus of claim 1, further comprising a second and a third longer artificial foliage bundle mounted to the shaft.

3. The apparatus of claim 2, wherein the coating resembles a tree branch.

4. The apparatus of claim 2, wherein the three longer artificial foliage bundles have stems that are bent around the shaft wire.

5. The apparatus of claim 4, wherein the stems of the three longer artificial foliage bundles are within the sheath to attach the three longer bundles to the shaft.

6. The apparatus of claim 4, wherein the shaft wire is two wires twisted together.

7. The apparatus of claim 6, wherein the stems of the three longer bundles are inserted into a gap between shalt wires.

8. The apparatus of claim 1, wherein the side branches are bent around the shaft wire.

9. The apparatus of claim 8, wherein one end of each side branch is within the sheath to attach the side branches to the shaft.

* * * * *